US012560354B2

(12) United States Patent
Buff

(10) Patent No.: US 12,560,354 B2
(45) Date of Patent: Feb. 24, 2026

(54) HEAT EXCHANGER PANEL FOR CONTROLLING THE TEMPERATURE OF A ROOM

(71) Applicant: interpanel GmbH, Crossen an der Elster (DE)

(72) Inventor: Alexander Buff, Crossen an der Elster (DE)

(73) Assignee: interpanel GmbH, Crossen an der Elster (DE)

( * ) Notice: Subject to any disclaimer, the term of this patent is extended or adjusted under 35 U.S.C. 154(b) by 0 days.

(21) Appl. No.: 18/865,753

(22) PCT Filed: May 12, 2023

(86) PCT No.: PCT/EP2023/062743

§ 371 (c)(1),
(2) Date: Nov. 14, 2024

(87) PCT Pub. No.: WO2023/222539

PCT Pub. Date: Nov. 23, 2023

(65) Prior Publication Data

US 2025/0257899 A1 Aug. 14, 2025

(30) Foreign Application Priority Data

May 17, 2022 (DE) ..... 10 2022 112 411.8

(51) Int. Cl.
*F24F 13/22* (2006.01)
*F24F 5/00* (2006.01)
*F28F 3/12* (2006.01)

(52) U.S. Cl.
CPC ..... *F24F 13/222* (2013.01); *F24F 5/0089* (2013.01); *F28F 3/12* (2013.01)

(58) Field of Classification Search
CPC ..... F24F 5/0089; F24F 5/0092; F24F 2013/227; F24F 13/222; F24F 13/22;
(Continued)

(56) References Cited

U.S. PATENT DOCUMENTS 3,840,070 A 10/1974 Becker et al.
3,905,203 A 9/1975 Jacob
(Continued)

FOREIGN PATENT DOCUMENTS

CN 106051977 A 10/2016
CN 107289557 A 10/2017
(Continued)

OTHER PUBLICATIONS

International Search Report and Written Opinion of the International Searching Authority, mailed on Sep. 4, 2023, from International Application No. PCT/EP2023/062743, filed on May 12, 2023. 14 pages.
German Research Report, mailed on Jan. 12, 2023, from Germna Application No. 10 2022 112 411.8, filed on May 17, 2022. 18 pages.
(Continued)

*Primary Examiner* — Tavia Sullens
(74) *Attorney, Agent, or Firm* — HoustonHogle LLP

(57) ABSTRACT

The invention relates to a heat exchanger panel comprising a heat exchanger. The heat exchanger has a medium line for conducting a heat exchange medium from a medium inlet to a medium outlet and a heat-conducting heat exchanger wall which is connected to the medium line, and the heat exchanger wall forms an interface facing a space which can be brought to a lower temperature than a heat load. At least one surface element is arranged between the boundary surface and the room, which is at least partially permeable to heat radiation and virtually impermeable to air, so that a virtually airtight intermediate space is formed between the boundary surface and the surface element. The heat exchanger is characterized by the fact that a condensation cavity is formed in the area adjacent to the medium inlet, adjacent to the medium line and on the side facing away from the heat exchanger wall with respect to the surface element, and the heat exchanger wall has at least one opening so that the intermediate space is connected to the condensation cavity in a communicating manner. A capillary material is arranged in the condensation cavity or at least one capillary-active element is provided, which is guided to an
(Continued)

Figure 1:
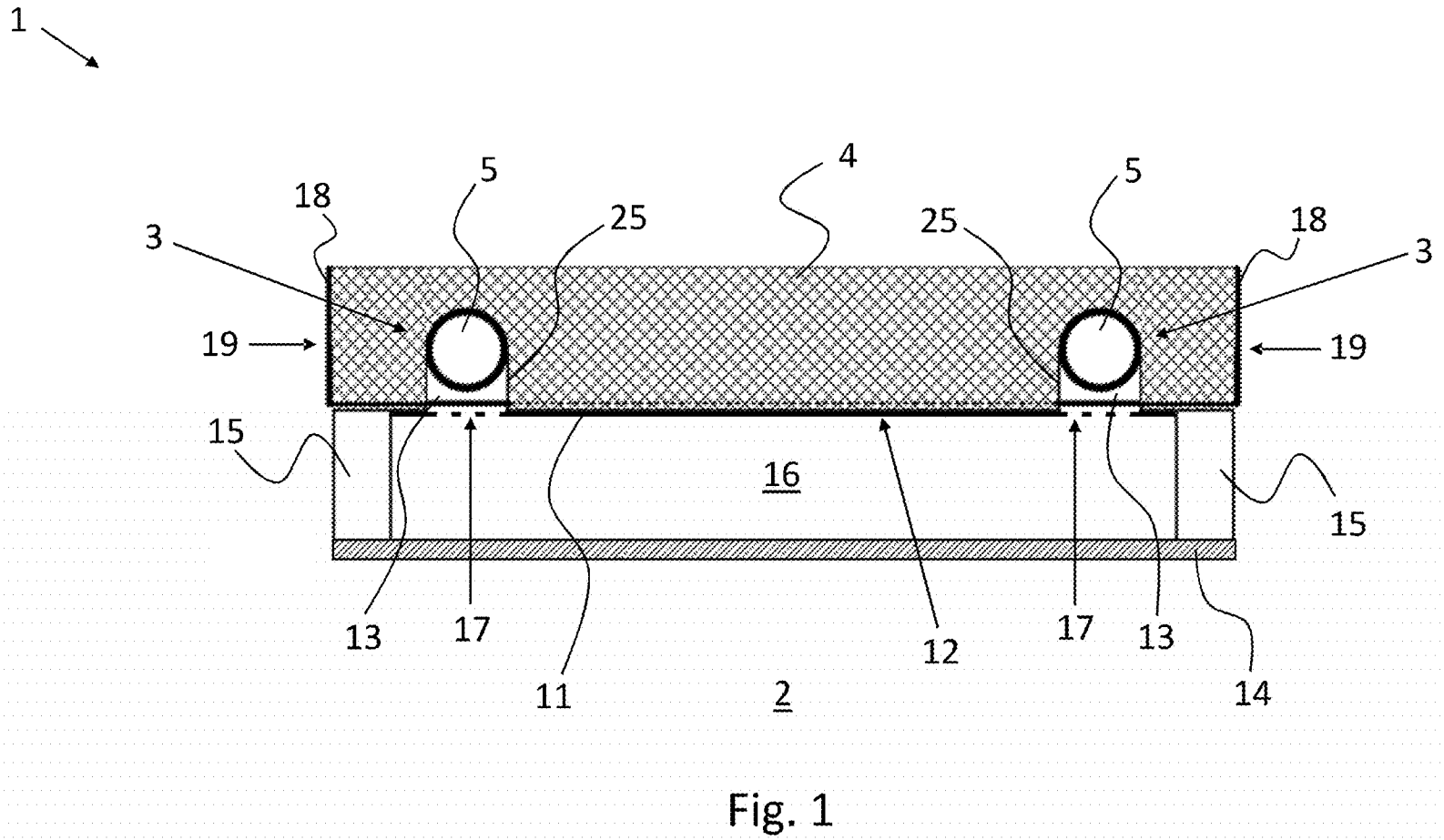

outer surface of the heat exchanger panel, so that liquid condensing in the condensation cavity is transported to the outside due to the capillary effect of the capillary material or the capillary-active element and can dry out there again.

13 Claims, 9 Drawing Sheets

(58) Field of Classification Search
CPC .... F24F 3/12; F24F 3/1411; F24F 2003/1435; F28F 3/12
See application file for complete search history.

(56) References Cited

U.S. PATENT DOCUMENTS

| | | | | |
|---|---|---|---|---|
| 5,931,381 | A * | 8/1999 | Fiedrich | F24F 5/0089 165/49 |
| 2018/0172296 | A1* | 6/2018 | Buff | F24F 5/0089 |

FOREIGN PATENT DOCUMENTS

| | | | |
|---|---|---|---|
| CN | 107995944 | A | 5/2018 |
| CN | 110319514 | A | 10/2019 |
| CN | 111520847 | A | 8/2020 |
| CN | 111912066 | A | 11/2020 |
| DE | 3500294 | A1 | 7/1986 |
| DE | 102015211473 | A | 12/2016 |
| JP | 000H06323577 | A | 11/1994 |
| WO | WO 2016207141 | A2 | 12/2016 |

OTHER PUBLICATIONS

International Preliminary Report on Patentability, mailed on Nov. 28, 2024, from International Application No. PCT/EP2023/062743, filed on May 12, 2023. 13 pages.
Chinese First Office Action, mailed on Jul. 23, 2025, from Chinese Application No. 202380040843.1, filed on May 12, 2023. 11 pages.

* cited by examiner

HEAT EXCHANGER PANEL FOR CONTROLLING THE TEMPERATURE OF A ROOM

RELATED APPLICATIONS

This application is a § 371 National Phase Application of International Application No. PCT/EP2023/062743, filed on May 12, 2023, now International Publication No. WO/2023/222539, published on Nov. 23, 2023, which International Application claims priority to German Application 10 2022 112 411.8, filed on May 17, 2022, all of which are incorporated herein by reference in their entirety.

The invention relates to a heat exchanger panel for controlling the temperature of a room and a method for controlling the temperature of a room with such a heat exchanger panel.

It is known to heat or cool a building component, e.g. by means of a heated or cooled pipe register, to control the temperature of buildings, i.e. for heating and cooling. In this way, the component can transfer heat to the room air and surrounding surfaces through radiation exchange or absorb heat from the room air and surrounding surfaces and heat loads in the room, thereby influencing the indoor climate. Ceiling panels, wall panels or underfloor heating systems are often equipped with a water-guided pipe register or electrically operated heating wire. This can be installed directly during the construction of the building or retrofitted to an existing building.

DE 10 2015 211 473 A1 and WO 2016/207141 A2 describe a device for air conditioning a room. The device comprises a heat sink that has a surface facing the room. The surface is brought to a temperature lower than that of the room by means of the heat sink. The heat sink is realized, for example, by cooling pipes. Water, a water/glycol mixture or refrigerant can flow through the cooling pipes. Instead of the cooling pipes, electrically cooled components can also be provided, e.g. via Peltier elements. The device also includes a surface element between the surface and the room. The surface element is virtually impermeable or impermeable to room air and water vapor, but transparent to heat radiation. In addition, a dehumidification device is disclosed to be arranged in the area between the surface and the room in order to remove minor moisture. The dehumidification device can be, among other things, a sorbent and/or a heating device and/or a fleece.

In this known heat exchanger device, the fleece is applied to the entire surface of the heat sink and extends over the sides of the heat exchanger device into a rear area in order to dry there. The problem here is that if the fleece is arranged over the entire surface, large amounts of water accumulate, leading to an uncontrolled state. As a result, the moisture is not always discharged into the rear area of the heat exchanger device as intended, but can remain partially in the device. This impairs the performance of the heat exchanger device and can lead to damage to the device in the long term. As such a heat exchanger device should be designed for continuous operation over a long period of time, this is a serious problem.

U.S. Pat. No. 3,905,203 A discloses an air cooling and water condensate removal device comprising a thin plate. The plate has a fine, wettable, serrated or porous surface on one side. The opposite side of the plate is thermally insulated. A cooling plate is arranged inside the plate, for example with a circulating liquid coolant. The coolant is used to cool the wettable surface so that moisture from the air condenses. The resulting condensate is drained off using capillary systems.

JP H06-323577 A discloses a cooling device for homes and offices which absorbs heat radiation to cool the room. The cooling device comprises a panel which is thermally insulated on the wall side. A thin polymer layer is provided on the room side of the panel, which allows heat radiation to pass through and protects the panel from direct air contact. The panel is cooled by circulating water.

CN 111 912 066 A describes a radiant air conditioner. The radiant air conditioner comprises an energy transfer layer facing away from the room, a damping layer and a radiation panel facing the room. The energy transfer layer is in thermal contact with the radiant panel via the damping layer and can be used to change the temperature of the radiant panel. An adjustment device is provided with which the thickness of the damping layer can be adjusted. This allows the temperature of the radiation panel to be precisely adjusted.

Based on this state of the art, the present invention is based on the task of providing a heat exchanger panel for controlling the temperature of a room, which controls the temperature of the room in an energy-efficient manner and allows a more controlled formation of condensate between a heat sink and a surface element which is arranged at some distance from the heat sink.

This task is solved by the objects with the features of the independent patent claim. Advantageous embodiments are given in the dependent claims.

According to the invention, a heat exchanger panel is provided which comprises a heat exchanger. The heat exchanger has a medium line for guiding a heat exchange medium from a medium inlet to a medium outlet and a heat-conducting heat exchanger wall, which is connected to the medium line. The heat exchanger wall forms a boundary surface facing a room, which can be brought to a lower temperature compared to a heat load. At least one surface element is arranged between the boundary surface and the room, which is at least partially permeable to heat radiation and virtually impermeable to air, so that a virtually airtight intermediate space is formed between the boundary surface and the surface element.

The heat exchanger panel is characterized in that a condensation cavity is formed in the area adjacent to the medium inlet, adjacent to the medium line and on the side facing away from the heat exchanger wall with respect to the surface element, and the heat exchanger wall has at least one opening, so that the intermediate space is connected to the condensation cavity in a communicating manner. A capillary material is arranged in the condensation cavity or at least one capillary-active element is provided, which is guided to an outer surface of the heat exchanger panel, so that liquid condensing in the condensation cavity is transported to the outside due to the capillary effect of the capillary material or the capillary-active element in order to dry out there. The condensation cavity is a cavity in the sense that it is free of other bodies so that air can enter it and the moisture it contains can condense.

The heat exchanger panel described has the heat exchanger and the intermediate space formed between the boundary surface of the heat exchanger wall and the surface element. In a theoretical and idealized design of the heat exchanger panel, this intermediate space is completely sealed, so that there is no air exchange and no water vapor entry at a vapor pressure gradient with the environment. This is very difficult to achieve in practice, which is why there is almost always an exchange of air, water vapor entry and therefore moisture entry.

As the heat exchanger panel is exposed to a temperature difference between the cold boundary surface and the warm room air during operation, humidity accumulates over time in the intermediate space, which condenses on the cold boundary surface. It must also be taken into account that such a heat exchanger panel is used in continuous operation over a long period of time. The main transport mechanism for the entry of moisture is water vapor diffusion due to the partial pressure gradient of the different climates. The water vapor partial pressure in the room is higher than that in the intermediate space.

In principle, a lower water vapor saturation pressure will prevail in the condensation cavity than in the rest of the almost airtight intermediate space. The resulting diffusion pressure gradient results in a permanent flow of material from any entry point of the water to the condensation cavity. Due to the low amount of water vapor, the natural vapor pressure equalization is sufficient to transport liquid from the condensation cavity to an outer surface of the heat exchanger panel by means of the capillary effect of the capillary material, where it then evaporates. This enables continuous drying of the intermediate space.

WO 2016/207141 A2 does show a heat exchanger panel in which a fleece is arranged along a boundary surface of the heat sink and extends outwards and can transport moisture to the outside. However, this known heat exchanger panel does not have a condensation cavity, so that air can accumulate in it and cool down, so that the moisture contained in the air condenses.

The capillary material can be a non-woven or woven fabric or a sorptive material. The capillary material can, for example, be a polymer film, in particular a polyamide film or a polyester film.

The term capillary material refers to materials that are fundamentally capable of absorbing liquids, in this case water. The materials are also characterized by the fact that they have pores, whereby a structure is formed by the pores, whereby the liquids move inside the material primarily due to capillary forces. Capillary tension is a special form of surface tension. The pores can be macroscopic pores or microscopic pores on a molecular level, such as hollow fibers in a polyamide or polyester film. To the human observer, a polyamide film is a smooth, pore-free film. However, it has very small pores that are suitable for absorbing water and cause water to spread through the film. With such small pores, molecular interactions can also influence the spread of water in the film.

Capillary channels can also be incorporated into the heat exchanger wall so that no fleece or fabric is required. In this case, the heat exchanger wall also forms the capillary material and leads into an outer area of the heat exchanger panel. The capillary channels can be worked into the surface of the heat exchanger wall using a laser, for example. Preferably, the capillary channels are formed in the surface of the heat exchanger wall facing the condensation cavity and only as far as the condensation cavity in the heat exchanger wall.

It is intended to cool the boundary surface of the heat exchanger wall. The heat exchanger wall is a wall with good thermal conductivity, whereby the boundary surface of the heat exchanger wall represents the surface of the heat exchanger in the direction of the intermediate space. The heat exchanger wall is used to create thermal contact between individual elements of the medium line, thereby increasing the cooling surface of the heat exchanger. The boundary surface is cooled by a cold medium that is passed through the medium line. As a result, the medium line is cooled first and the surface of the medium line as well as the heat exchanger wall and the interface become cold due to heat conduction. The medium line has the coldest point close to the medium inlet. The further the medium line extends in the direction of the medium outlet, the warmer it becomes.

The heat load in the room can be caused by solar radiation or the heat emitted by people, for example. The infrared heat radiation emitted by the heat load is absorbed by the boundary surface and removed from the room by the cold medium.

The condensation cavity is provided adjacent to the medium line in the area adjacent to the medium inlet. The condensation cavity is a small air cavity that is formed on the side facing away from the heat exchanger wall with respect to the surface element. In this area, the heat exchanger wall has at least one opening so that the intermediate space communicates with the condensation cavity. The humidity that accumulates in the intermediate space thus passes through the opening from the intermediate space into the condensation cavity, where it condenses on the cold medium line. The capillary material arranged in the condensation cavity, which is guided to an outer surface of the heat exchanger panel in a vapor-diffusion and airtight manner, transports the condensing liquid to the outside due to the capillary effect of the capillary material, where it can dry in the air. The pores of the capillary material are so fine that only a minimal amount of moisture enters the capillary material through diffusion, both inside and outside the heat exchanger panel. This means that virtually no water vapor can penetrate from the outside or that there is virtually no gas flow from the outside towards the condensation cavity. If the pores are filled with water in the event of condensation, they are impermeable to vapor diffusion. As the condensed water is distilled water, there is no risk of the pores becoming blocked. In addition, no liquid flows through the capillary material from the outside to the condensation cavity, as the water vapor pressure and material moisture of the capillary material inside the condensation cavity is greater than on the outer surface.

Due to the different cold distribution of the medium line described above, the humidity that accumulates in the intermediate space is not distributed evenly throughout the entire intermediate space, but condenses primarily at the coldest point of the medium line. As the moisture is thus removed from the air at this point, more air with higher humidity flows in this direction and the moisture condenses again.

With the arrangement described, it is not necessary to arrange the capillary material along the entire heat exchanger. The fact that the moisture condenses primarily in the area of the medium inlet on the medium line is utilized. For this reason, the condensation cavity in which the moisture collects is provided in this area of the medium line. It is therefore only necessary to provide the capillary material there in order to remove the moisture effectively and in a controlled manner.

The provision of the condensation cavity on the side facing away from the heat exchanger wall with respect to the surface element and with at least one opening that connects the intermediate space with the condensation cavity in a communicating manner, means that the heat radiation transmitting through the surface element does not directly contact the medium line. The medium line is thus shielded from a large part of the heat radiation by the heat exchanger wall and remains in a cool state.

The medium line can consist of one or more straight line sections or a meandering line.

In one embodiment of the heat exchanger panel, the heat exchanger has a meandering medium line.

The medium line is preferably designed in such a way that it has a supply line and a discharge line with a large cross-section, which are arranged approximately parallel to each other and connecting lines with a smaller cross-section are arranged between them. The connecting lines run approximately parallel to each other and connect the supply line and the discharge line. These connecting lines can be capillary tubes and such a line system with capillary tubes is also referred to as a capillary tube mat, especially if the lines are made of plastic.

The heat exchanger panel can comprise a ceiling or wall panel in which the medium line is embedded. The medium line is preferably integrated into the ceiling or wall panel in such a way that the material of the ceiling or wall panel fills the spaces between the individual elements of the medium line. The space between the boundary surface and the panel element can be bordered on the side by edge elements.

The ceiling or wall panel and the edge elements can be made of an essentially diffusion-tight material. This design minimizes the heat input into the medium line and the moisture input into the space between the boundary surface and the panel element.

The boundary surface of the heat exchanger wall is particularly relevant for the temperature control of the room. This boundary surface can be smooth or rough in order to influence its absorption or reflection behavior. The heat exchanger wall can, for example, be a layer of metal or contain or consist of a metallic alloy. The performance of the heat exchanger panel according to the invention can be increased by a high thermal conductivity and/or high heat capacity of the interface and high absorption in the radiation range of the temperature radiation of 2 to 20 μm wavelength. On the other hand, the response behavior of the heat exchanger panel can be specifically influenced by a low or high heat capacity of the boundary surface, or by additionally introduced or attached latent heat storage materials (PCM).

The area in which the condensation cavity is formed adjacent to the medium inlet can comprise at least 10% or at least 20% or at least 30% of a length of the medium line.

This design ensures that the condensation cavity covers the area in which the medium line is coldest and most of the condensate accumulates. Such a limited area, in which the capillary material is also located, means that there is no large accumulation of water and the condensate can be discharged in a controlled manner.

In a preferred embodiment, which uses a capillary mat having a collecting line, the condensation cavity is formed along a large part of the collecting line with which the cooling medium is supplied to the capillary mat. Preferably, the condensation cavity extends over an area of at least 60%, in particular at least 70%, in particular preferably at least 90% of this manifold.

As the condensation cavity, unlike the surface of the heat exchanger wall, does not receive any heat radiation, it is fundamentally cooler than the heat exchanger wall.

Only partial areas can be covered with the capillary material, but these would be even cooler due to the absence of the capillary material.

Several openings can be formed in the heat exchanger wall, whereby the openings have a minimum clear width of at least 0.2 mm or at least 0.3 mm or at least 0.4 mm and/or a maximum clear width of 1.5 mm or a maximum of 1.4 mm or a maximum of 1.3 mm. The openings can also be designed as elongated or longitudinal slits or combinations of slits and round openings. The heat exchanger wall can also be made of a diffusion-open material in the area of the condensation cavity.

In a preferred embodiment of the heat exchanger panel, the heat exchanger wall has openings in the form of perforations. The hole size of the perforation is selected so that water vapor can flow through, but not liquid water. This prevents water from dripping from the condensation cavity towards the surface element and accumulating there. This would lead to damage to the heat exchanger panel in the long term.

At a wavelength between approximately 3 μm and approximately 30 μm or between approximately 6 μm and approximately 20 μm, the surface element can exhibit a transmission of more than approximately 50% or more than approximately 70% or more than approximately 90%, at least in a partial range.

The surface element decouples the heat exchange at the boundary surface of the heat exchanger wall by means of heat radiation and heat conduction. As a result, the boundary surface can be cooled to a temperature below the dew point of the humidity in the room air. Heat can thus be effectively extracted from the room by thermal radiation. The surface element can, for example, contain or consist of a polymer.

The wavelength range mentioned contains a large part of the energy of the thermal radiation of a black body radiator at around 300 K. If the heat exchanger panel according to the invention is to be used in a warmer climate, this wavelength range may be shifted. Shorter wavelengths can also occur if the room has special heat sources, for example electrical or electronic devices. A transmission of around 50% to around 90% in at least part of the wavelength range mentioned ensures that a sufficient proportion of the heat radiation reaches the boundary surface of the heat exchanger wall and can be transported out of the room in this way. At the same time, the transparency and the associated low degree of absorption and emissivity of the surface element in the aforementioned wavelength range of the material ensure that the surface element emits little thermal energy to the boundary surface and therefore does not cool down and thus does not fall below the dew point of the humidity in the room air.

At the same time, the surface element can be at least partially reflective and/or absorbent in the visible spectral range, enabling a visually appealing design.

A trough can be provided which completely or almost completely encloses the ceiling or wall panel on the side facing the ceiling or wall, and/or which completely or almost completely encloses the medium line and the condensation cavity on the side facing the ceiling or wall. The trough can be made of a diffusion-tight material, preferably a metal such as aluminum.

The tough thus insulates the ceiling or wall panel and subsequently also the condensation cavity from the surroundings on the ceiling or wall side, which are normally formed by an insulating material that is not completely diffusion-tight. If the trough only encloses the medium line and the condensation cavity, the medium line and the condensation cavity in particular are insulated from the surroundings.

A heat-insulating and/or sound-absorbing layer and/or a layer that is impermeable to water vapor can be provided on a side of the heat exchanger panel facing away from the room.

The heat-insulating layer can, for example, reduce energy losses from a room to the outside or into volumes and surfaces that are not to be heated. The sound-absorbing layer reduces the sound level in the room by absorbing sound waves and converting them into thermal energy. Among other things, this improves speech intelligibility in rooms. The sound-absorbing layer is, for example, an acoustic foam and is preferably made of the same material as the diffusion-tight thermal insulation material. Compared to the thermal insulation material, the acoustic foam has a more open-pored surface. The water vapor diffusion-tight layer prevents moisture from entering the ceiling and/or the wall of the room or on the surface of the heat exchanger.

Electronic components such as sensors, semiconductors, LEDs and/or other active or passive components or thermal or hygroscopic storage materials can be arranged between the heat exchanger wall and the surface element and/or on the side of the surface element facing the room.

The components can also be electrothermal components, such as Peltier elements. A PCM material can also be used for thermal buffering in certain embodiments.

Electronic components such as LEDs can be provided for decorative and technical purposes. For example, a heat exchanger panel according to the invention can not only be used to control the temperature of a room, but can also contribute to the visual design and workplace lighting of the room with lighting elements. In warehouses or laboratories, where a constant temperature and/or constant humidity are very important, sensors can be provided to permanently monitor these values.

Furthermore, a method according to the invention is provided for cooling a room with a heat exchanger panel as described above, comprising the following steps, Conducting a cool heat exchanger medium in a medium line, Condensation of moisture in a condensation cavity adjacent to the medium line, Absorption of the moisture by a section of capillary material arranged in the condensation cavity, and Removal of moisture by means of the capillary effect of the capillary material to an outer surface of the heat exchanger panel.

The advantages described above with reference to the intake system apply analogously to the method according to the invention.

Figure 4:
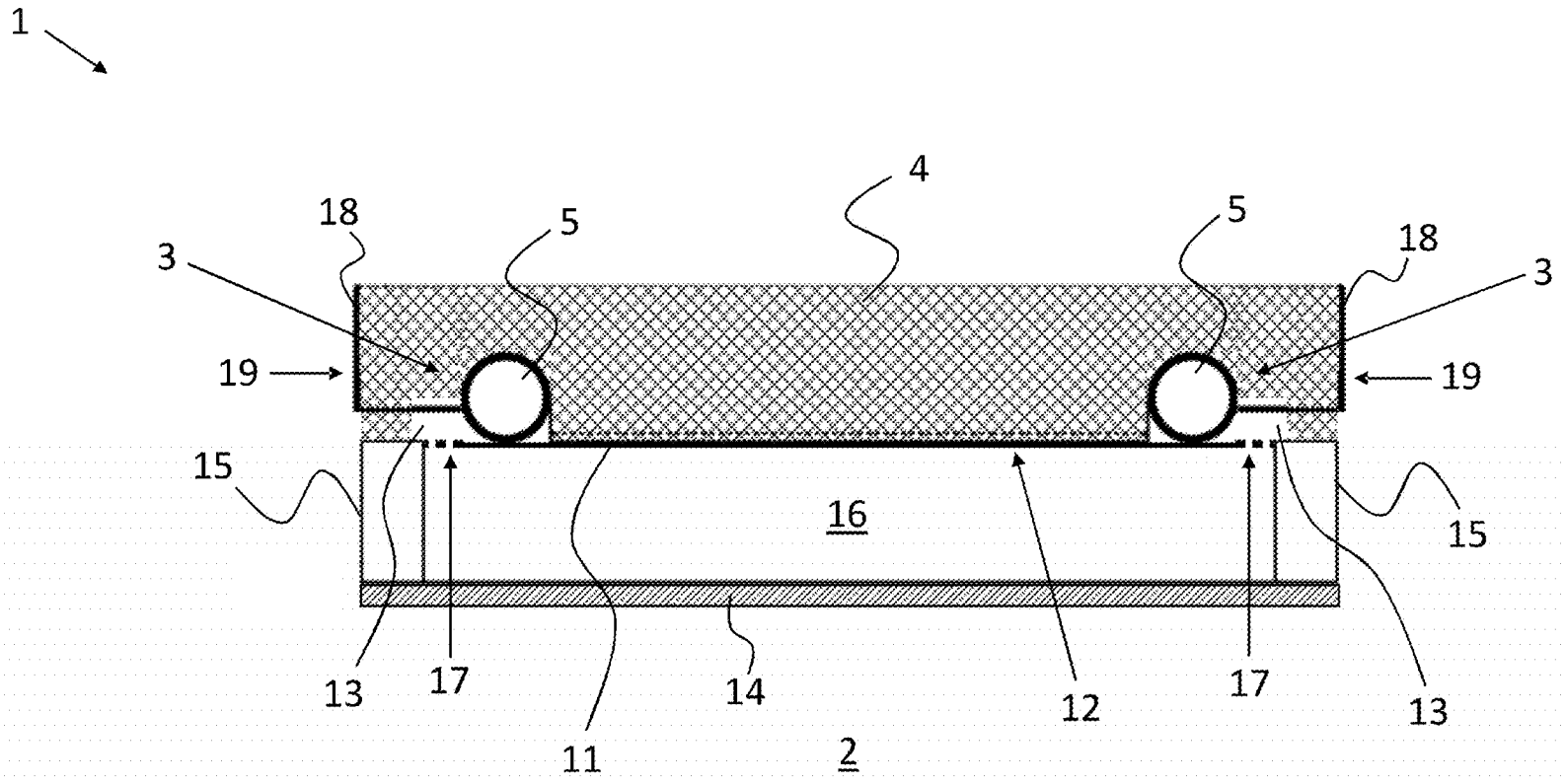
Figure 5:
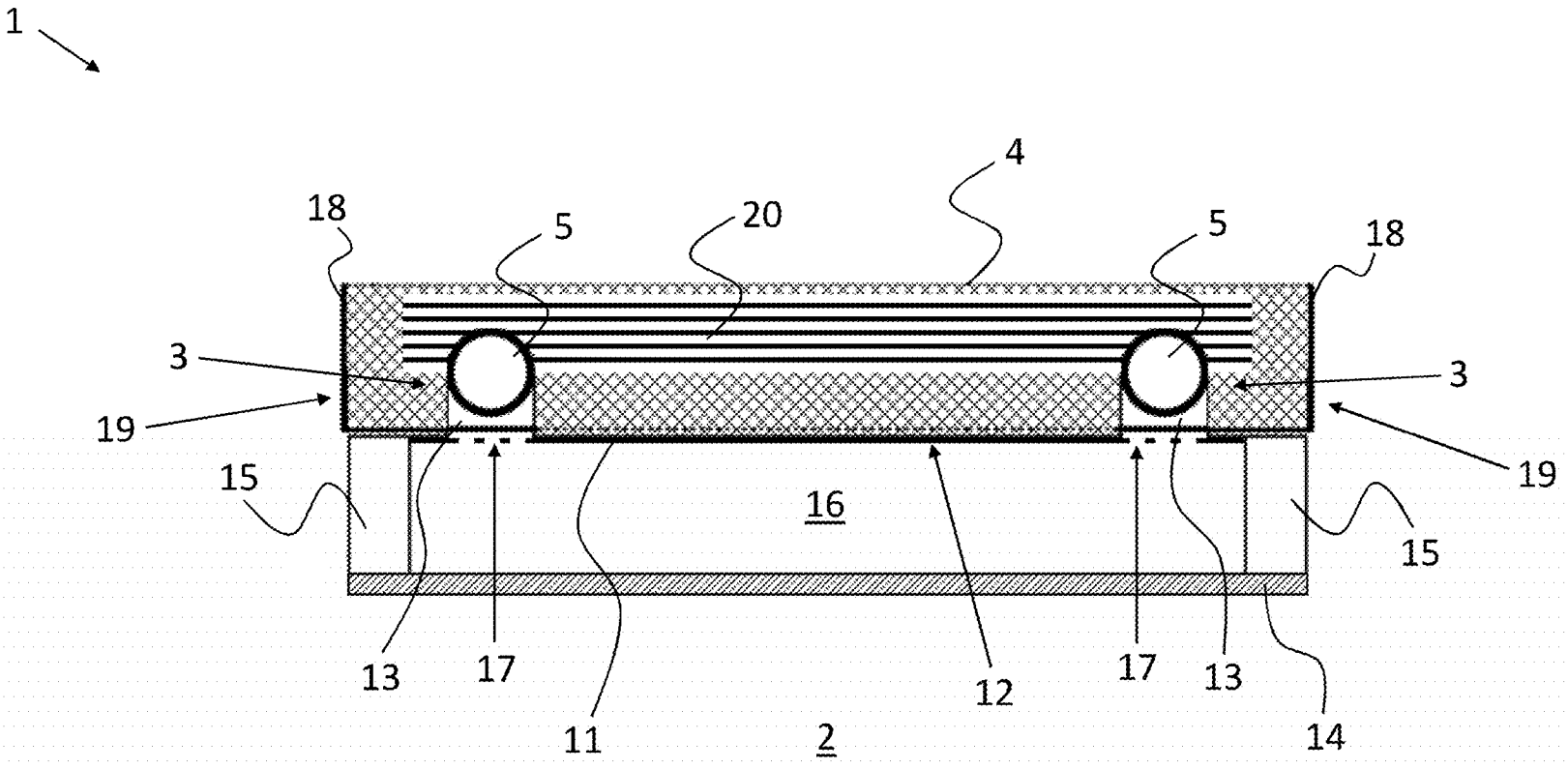
Figure 6:
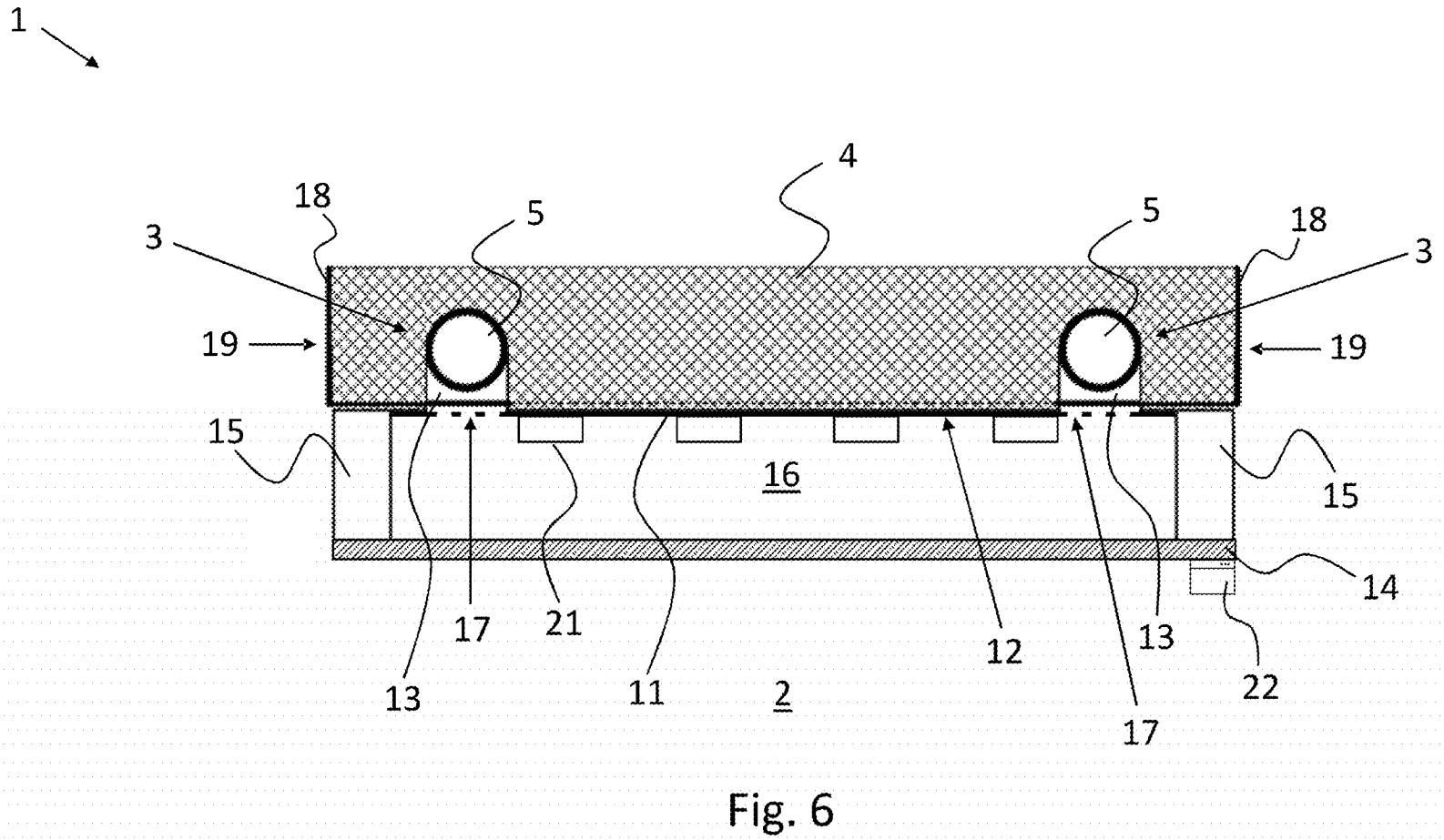

Further tasks, features and advantages of the present invention will become apparent from the description and the exemplary embodiment shown in the accompanying drawings. These show in:

FIG. 1A schematic representation of a heat exchanger panel according to the invention, integrated into a ceiling or wall panel, in a first embodiment; in a lateral view, in FIG. 2A schematic representation of a heat exchanger panel according to the invention, integrated into a ceiling or wall panel, in a first embodiment with a trough in a first embodiment; in a lateral view, in FIG. 3A schematic representation of a heat exchanger panel according to the invention, integrated into a ceiling or wall panel, in a first embodiment with a trough in a second embodiment; in a lateral view, in FIG. 4A schematic representation of a heat exchanger panel according to the invention, integrated into a ceiling or wall panel, in a second embodiment; in a lateral view, in FIG. 5A schematic representation of the heat exchanger panel according to the invention, integrated into a ceiling or wall panel, in a third embodiment; in a lateral view, in FIG. 6A schematic representation of the heat exchanger panel according to the invention, integrated into a ceiling or wall panel, in a fourth embodiment; in a lateral view, in FIG. 7A schematic representation of the heat exchanger panel according to the invention, integrated into a ceiling or wall panel and connected to a heat exchanger, in a first embodiment; in a schematic view, in FIG. 8A schematic representation of the heat exchanger panel according to the invention, integrated into a ceiling or wall panel and connected to a heat exchanger, in a second embodiment, and in FIG. 9A schematic representation of the heat exchanger panel according to the invention, integrated into a ceiling or wall panel and connected to a heat exchanger, in a third embodiment.

Figure 2:
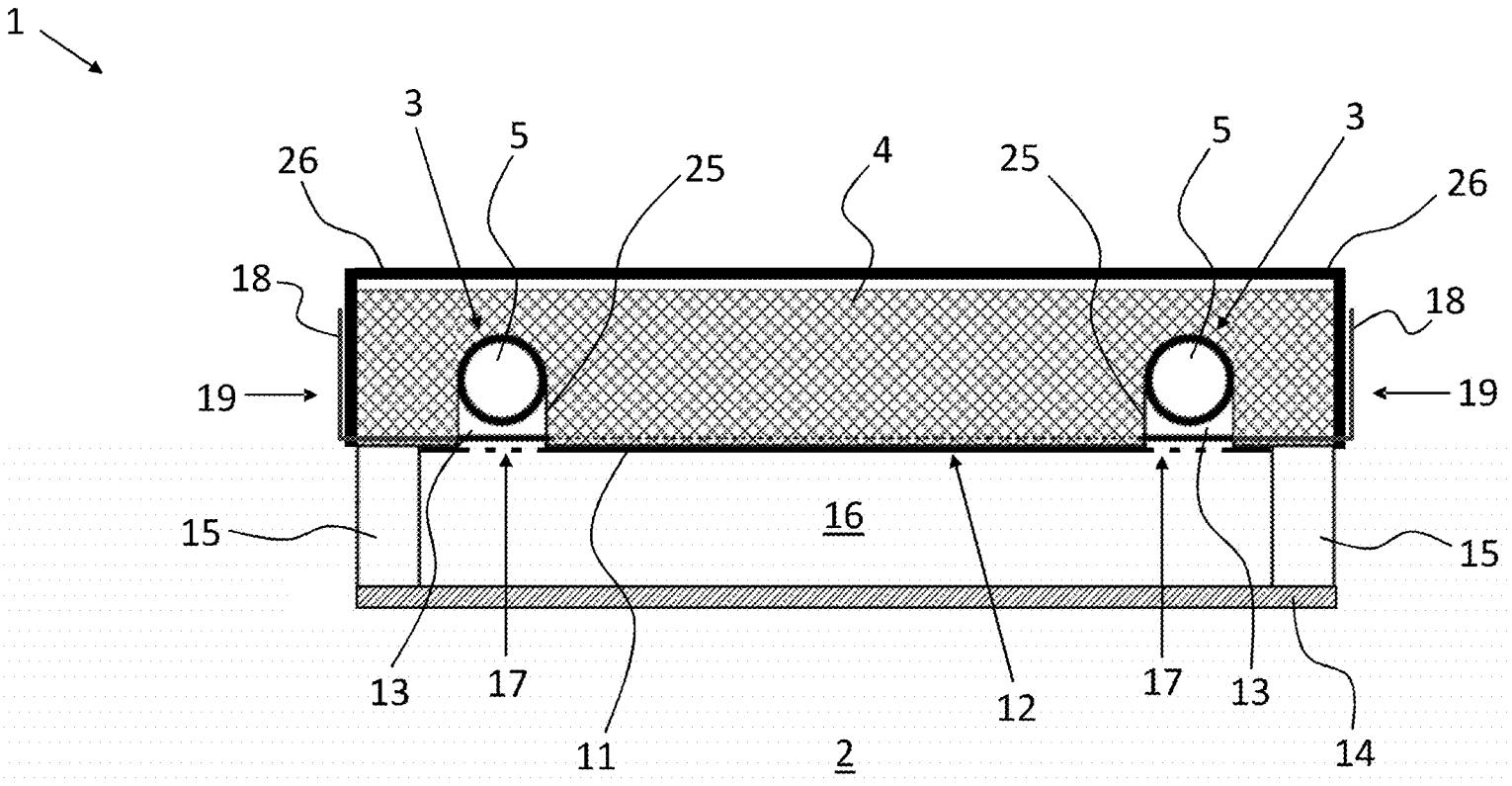
Figure 3:
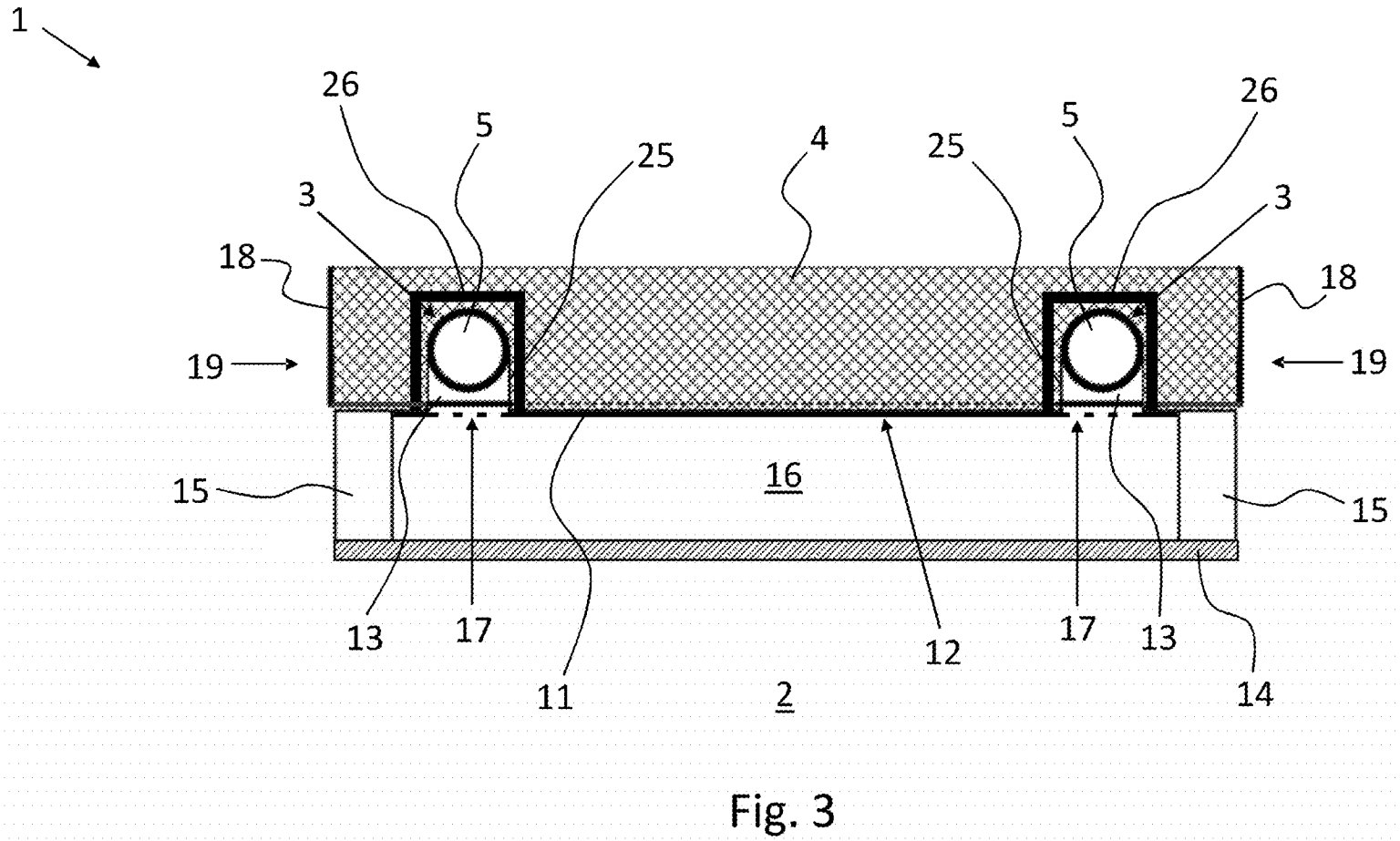

In the following, a heat exchanger panel 1 according to the invention for controlling the temperature of a room 2 is described in more detail using a first embodiment as an example (FIGS. 1 to 3). The room 2 has a heat load.

The heat exchanger panel 1 comprises a heat exchanger 3. The heat exchanger 3 is integrated into a ceiling or wall panel 4. The heat exchanger 3 has a medium line 5.

Figure 7:
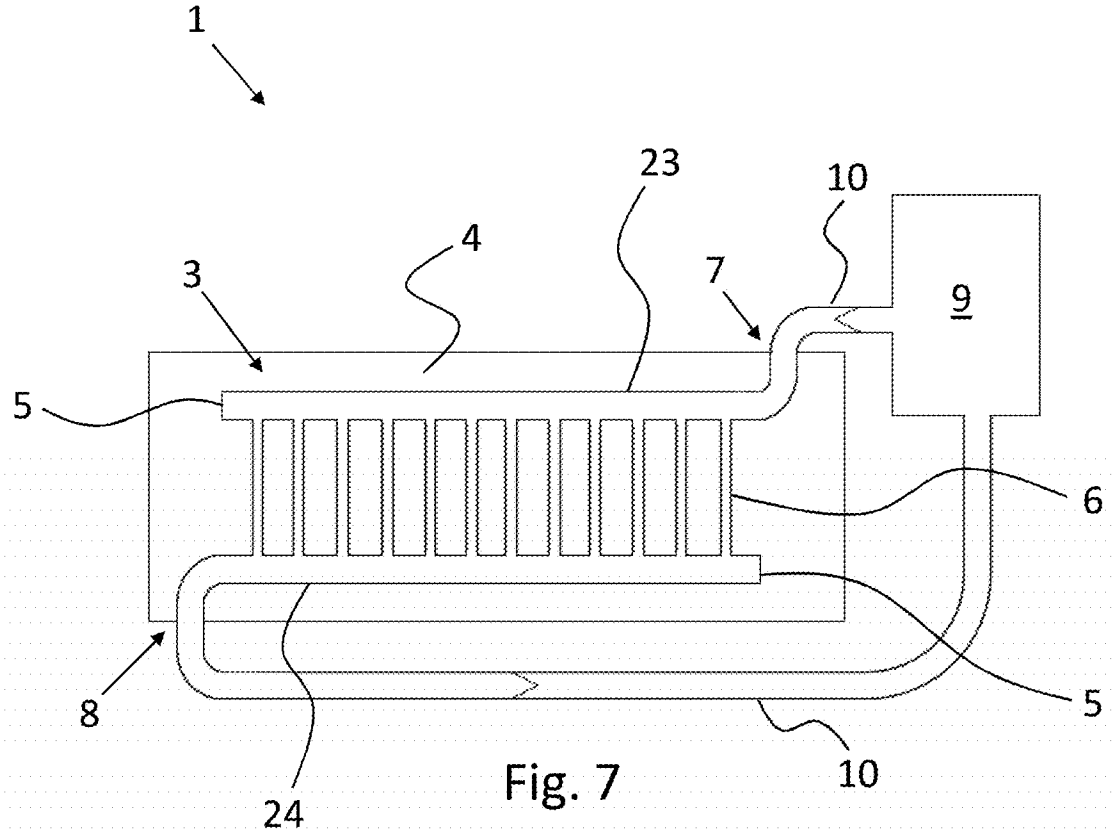

The medium line 5 comprises a supply line 23 and a discharge line 24 with a large cross-section. The supply line 23 and the discharge line 24 are arranged approximately parallel to each other. Connecting lines 6 with a smaller cross-section are arranged between them. The connecting lines 6 run approximately parallel to each other and connect the supply line 23 and the discharge line 24. The connecting lines 6 are preferably capillary tubes. The supply line 23, the discharge line 24 and the connecting lines 6 are preferably made of plastic, so that together they form a capillary tube mat (FIG. 7). The medium line 5 and/or the connecting lines 6 can also be made of metal.

Figure 8:
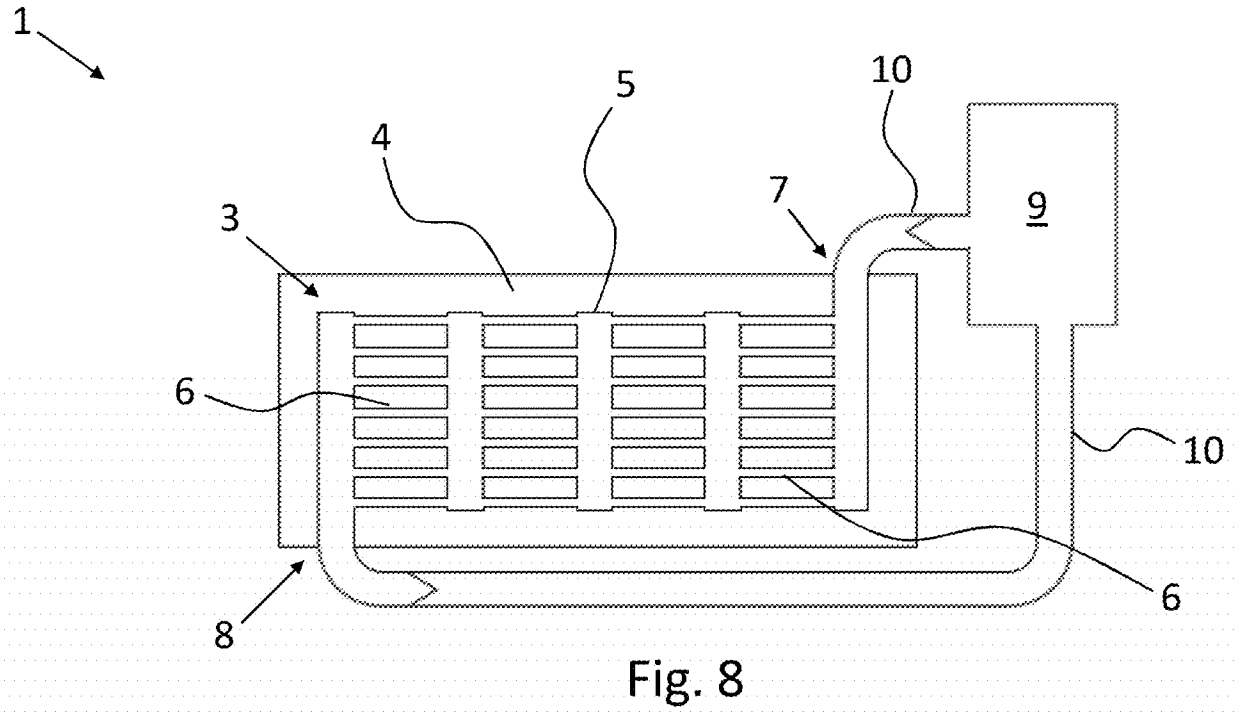

The heat exchanger 3 can also have several medium lines 5 with a large cross-section in sections, which are connected to each other by means of the connecting lines 6 (FIG. 8). In this case, the several medium lines 5 are arranged parallel to each other and are each connected to each other by several connecting lines 6, which are arranged perpendicular to them and again run parallel to each other. The connecting lines 6 are preferably capillary tubes. The heat exchanger 3 can also have a meandering medium line 5 (FIG. 9).

The medium is a refrigerant in the form of a fluid that is used to absorb heat. The refrigerant can be chilled water, for example. A refrigerant, e.g. R32 or R290, can also flow directly through the heat exchanger 3.

The medium line 5 of the heat exchanger 3 has a medium inlet 7 and a medium outlet 8. The heat exchanger medium usually flows through the medium line 5 from the medium inlet 7 in the direction of the medium outlet 8.

Figure 9:
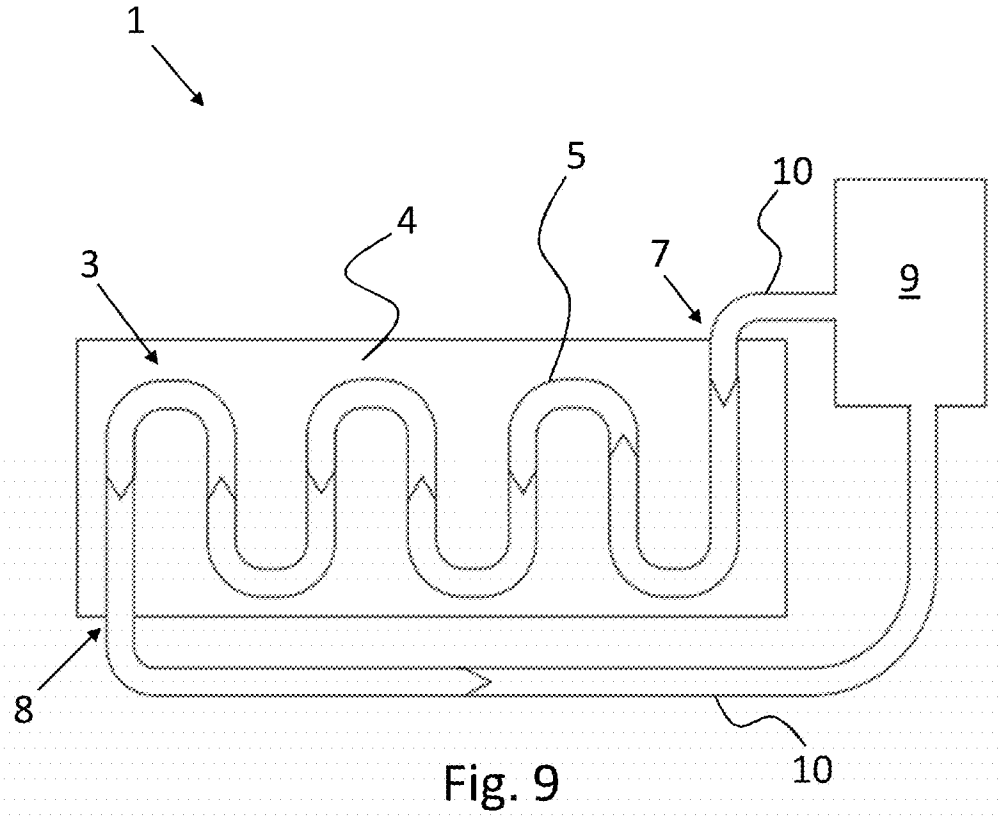

A heat pump 9 is provided to supply the cooled heat exchanger medium to the heat exchanger 3 via a pipe 10 (FIGS. 7 to 9). The heat exchanger medium is fed from the pipe 10 directly into the medium inlet 7 of the medium line 5 of the heat exchanger 3. After the heat exchanger medium has passed through the medium line 5, it leaves the medium line 5 through the medium outlet 8 and returns to the heat pump 9. The heat pump 9 and the heat exchanger 3 form a circuit. For example, a single heat pump 9 can be provided in a building, which is connected to a large number of heat exchanger panels 1 on different floors by means of several pipes 10 and provides the cooled heat exchanger medium to the heat exchangers 3. Alternatively, any heat sink can be integrated into the circuit. Systems with solar cooling, geothermal probes or groundwater cooling and therefore regenerative cooling sources are also possible.

The medium line 5 of the heat exchanger 3 is inserted into the ceiling or wall panel 4 in such a way that a material of the ceiling or wall panel 4 fills the spaces between the individual elements of the medium line 5. The material is preferably a diffusion-tight thermal insulation material.

The heat exchanger 3 has a heat-conducting heat exchanger wall 11, which is thermally connected to the medium line 5 and the connecting lines 6, so that the heat exchanger wall 11 is temperature-controlled by the medium line 5. On a side facing the room 2, the heat exchanger wall 11 forms a boundary surface 12. The boundary surface 12 represents the surface of the heat exchanger 3 facing the room 2. The temperature exchange between the room 2 and the heat exchanger medium flowing through the medium line 5 of the heat exchanger 3 essentially takes place at the boundary surface 12. The heat exchanger wall 11 is a layer made of a metal or another material with good thermal conductivity. By means of the heat exchanger wall 11, thermal contact is established between the individual elements of the medium line 5, thereby increasing the cooling surface of the heat exchanger 3.

The medium line 5 has the coldest point in the area of the medium inlet 7. The further the medium line 5 extends in the direction of medium outlet 8, the warmer it becomes. For this reason, a condensation cavity 13 is formed in this area adjacent to the medium inlet 7, adjacent to the medium line 5 and on the side facing away from the heat exchanger wall 11 with respect to the boundary surface 12. The condensation cavity 13 is a small air cavity.

The ceiling or wall panel 4 has a trough 26 on the ceiling or wall side, which completely or almost completely encloses the ceiling or wall panel 4 on the side facing the ceiling or wall (FIG. 2). In addition, the trough 26 protrudes into a lateral area of the ceiling or wall panel 4, so that the outer surface 19 is also enclosed. In the area of the edge element 15, the trough 26 is connected to the ceiling or wall panel 4 in a diffusion-tight manner, preferably bonded or welded. The trough 26 is made of a diffusion-tight material, such as a metal such as aluminum. However, it can also be made of plastic or realized by a coating inside the ceiling or wall panel 4. The trough 26 thus insulates the ceiling or wall panel 4 and subsequently also the condensation cavity 13 from the surroundings on the ceiling or wall side, which are normally formed by an insulating material that is not completely diffusion-tight.

It is also possible that the trough 26 merely encloses the medium line 5 and the condensation cavity 13, so that the medium line 5 and the condensation cavity 13 in particular are insulated from the environment (FIG. 3).

In one possible embodiment (FIG. 1), the medium line 5 is arranged at a slight distance from the heat exchanger wall 11 in the ceiling or wall panel 4. The intermediate space created by the distance between the medium line 5 and the heat exchanger wall 11 forms the condensation cavity 13. To ensure a good thermal connection between the medium and the heat exchanger wall 11, the connecting lines 6 are connected to the heat exchanger wall 6 and are therefore in direct thermal contact with the heat exchanger wall 6 (not shown).

If a hose system is used instead of the capillary tube system, which represents the medium line 5, then walls 25 made of a metal, such as aluminum, are provided, for example, which connect the medium line 5 and the heat exchanger wall 11 to one another in order to establish a good thermal connection between the medium line 5 and the heat exchanger wall 11.

In another possible embodiment (FIG. 4), the medium line 5 is arranged directly adjacent to the heat exchanger wall 11 in order to be directly thermally connected to it. The condensation cavity 13 is provided laterally adjacent to the medium line 5 at a slight distance from the heat exchanger wall 11. Preferably, the condensation cavity 13 is provided on the side of the medium line 5 that is closer to one edge of the heat exchanger 3. However, condensation cavities 13 can also be provided on both sides of the medium line 5. This has the advantage that an installation error with reversed orientation of flow and return cannot occur.

A surface element 14 is arranged at a distance from the boundary surface 12 on the side of the heat exchanger wall 11 facing the room 2. The surface element 14 is at least partially permeable to heat radiation and virtually impermeable to air and water vapor diffusion from the room 2. The surface element 14 may, for example, contain or consist of a polymer.

In a lateral area of the heat exchanger panel 1, edge elements 15 are provided between the heat exchanger wall 11 and the surface element 14. Together with the surface element 14, the edge elements 15 ensure that a virtually airtight gap 16 is formed between the heat exchanger wall 11 and the surface element 14.

The heat exchanger wall 11 has several openings 17 in the area of the condensation cavity 13. By means of the openings 17, the intermediate space 16 is connected to the condensation cavity 13 in a communicating manner. The openings 17 are formed, for example, by perforations in the heat exchanger wall 11. The hole size of the perforation is selected so that water vapor can flow through, but not liquid water. The openings 17 can be formed as elongated or longitudinal slits or combinations of slits and round openings. The heat exchanger wall 11 can also be made of a diffusion-open material in the area of the condensation cavity 13. It is also possible for the condensation cavity 13 to be completely exposed.

A capillary material 18 is provided in the condensation cavity 13. The capillary material 18 can be a non-woven or woven fabric or a sorptive material. The capillary material 18 can, for example, be a polyamide film or a polyester film. The condensation cavity 13 can be completely filled with the capillary material 18.

In the present embodiment example, the capillary material 18 is a fleece. It is therefore also possible to cover at least one opening 17 of the heat exchanger wall 11 with the fleece 18.

The fleece 18 leads to an outer surface 19 of the heat exchanger panel 1. Here, the fleece 18 extends through the ceiling or wall panel 4 and the trough 26 to the outer surface 19. The fleece 18 is bonded to the ceiling or wall panel 4 and the trough 26 in such a way that a connection is formed between the fleece 18 and the ceiling or wall panel 4 or the trough 26 that is as vapor diffusion- and airtight as possible. The adhesive is viscous enough to reliably bond the surface of the fleece 18 to the ceiling or wall panel 4 or the trough 26, but not so viscous that it can penetrate the pores of the fleece 18 and block them.

If the cold heat exchanger medium flows through the medium line 5, the medium line 5 cools down first and the surface of the medium line 5 cools down due to heat conduction. As a result, the heat exchanger wall 11 connected to the medium line 5 and thus the boundary surface 12 becomes cold.

Since the medium line 5 has its coldest point in the area of the medium inlet 7, the moisture in the intermediate space 16 is not distributed evenly in the intermediate space 16. The moisture condenses primarily at this coldest point of the medium line 5. Since the moisture is thus removed from the air at this point, further air with higher humidity flows in this direction and the moisture condenses again. The moisture passes through the openings 17 of the heat exchanger wall 11. The condensed moisture is absorbed by the fleece 18 and transported to the outside due to the capillary effect of the fleece 18, where it can dry in the air.

Instead of the capillary material 18, capillary channels (not shown) can also be provided in the heat exchanger wall 11. This means that no fleece or fabric is required. In this case, the heat exchanger wall 11 also forms the capillary material 18 and leads to the outer surface 19 of the ceiling or wall panel 4. The capillary channels can be worked into the surface of the heat exchanger wall 11 using a laser, for example. The capillary channels have a circular surface of at least 0.1 $mm^2$ or at least 0.3 $mm^2$ or at least 0.5 $mm^2$ and/or a circular surface of at most 1 $mm^2$ or at most 0.75 $mm^2$ or at most 0.5 $mm^2$.

Heat radiation emanating from a heat load in room 2 is at least partially transmitted through the surface element 13, from where it passes through the intermediate space 16 to the boundary surface 12 of the heat exchanger wall 11, where it is absorbed. The heat is absorbed and dissipated by the heat exchanger medium flowing through the medium line 5 via heat conduction. As the heat exchanger wall 11 also extends over the condensation cavity 13 and only has openings 17 that are only permeable to moisture, the condensation cavity 13 is shielded from a large part of the heat radiation. As a result, the condensation cavity 13 and the medium line 5 remain in a cooler state—or form the coolest point in the closed intermediate space 16.

According to a third embodiment (FIG. 5), a sound-absorbing layer 20 is incorporated into the material of the ceiling or wall panel 4. The sound-absorbing layer 20 is preferably an acoustic foam and is preferably made of the same material as the diffusion-tight thermal insulation material of the ceiling or wall panel 4. Compared to the thermal insulation material, the acoustic foam has a more open-pored surface.

The sound-absorbing layer 20 reduces the sound level and the reverberation time in room 2.

According to a fourth embodiment (FIG. 6), lighting elements 21 are provided on the side of the surface element 14 facing away from the room 2.

The lighting elements 21 can be provided both on the side of the surface element 14 facing the room 2 and on the side of the surface element 14 facing away from the room 2. The lighting elements 21 are LEDs, for example, which are mounted at a distance from one another on the surface element 14. In this way, a ceiling or wall panel 4 can not only serve to control the temperature of the room 2, but also contribute to the visual and technical design of the room 2 with lighting elements 21. The lighting elements 21 are preferably connected to a control device 22. The control device 22 can be controlled by means of a remote control. For example, the lighting elements 21 can be switched on and off individually or the brightness of the lighting elements 21 can be adjusted individually.

In addition to the lighting elements 21 or instead of the lighting elements 21, other electronic components (not shown), such as sensors, semiconductors, LEDs and/or other active or passive components or thermal storage materials can also be arranged on the surface element 14.

Both the lighting elements 21 and/or the other electronic components are arranged in such a way that a sufficiently large proportion of thermal radiation necessary for the invention can pass through the surface element 14 and reach the boundary surface 12. The lighting elements 21 and/or the further electronic components can also be designed in such a way that, like the surface element 14, they are at least partially permeable to thermal radiation and virtually impermeable to air.

In the following, a method according to the invention for a heat exchanger panel 1 according to the embodiment example of the present invention described above is explained.

A cool heat exchanger medium is fed through the medium line 5 of the heat exchanger 3 of the heat exchanger panel 1 in order to cool it.

Moisture in the intermediate space 16 of the heat exchanger panel 1 condenses in the condensation cavity 13 adjacent to the medium line 5.

The moisture accumulated in the condensation cavity 13 is absorbed by the section of capillary material 18 arranged in the condensation cavity 13.

Due to the capillary effect of the capillary material 18, the moisture in the capillary material 18 is conducted and discharged to an outer surface 19 of the heat exchanger panel 1.

This is where the moisture is released into the environment.

LIST OF REFERENCE SYMBOLS

1 Heat exchanger panel
2 Room
3 Heat exchanger
4 Ceiling or wall panel
5 Medium line
6 Connecting cables
7 Medium inlet
8 Medium outlet
9 Heat pump
10 Pipeline
11 Heat exchanger wall
12 Boundary surface
13 Condensation cavity
14 Surface element
15 Edge element
16 Intermediate space
17 Opening
18 Capillary material
19 Exterior surface
20 Sound-absorbing layer
21 Lighting element
22 Control unit
23 Supply line
24 Discharge line
25 Wall
26 Trough

The invention claimed is:

1. A heat exchanger panel comprising a heat exchanger that has a medium line for guiding a heat exchanger medium from a medium inlet to a medium outlet and a heat-conducting heat exchanger wall, which is connected to the medium line, and the heat exchanger wall forms a boundary surface facing a room, which can be brought to a lower temperature than a heat load, wherein at least one surface element is arranged between the boundary surface and the room, the at least one surface element being at least partially permeable to thermal radiation and virtually impermeable to air, so that a virtually airtight intermediate space is formed between the boundary surface and the surface element, wherein a condensation cavity is formed adjacent to the medium inlet, adjacent to the medium line and on a side of the medium line facing away from the heat exchanger wall with respect to the surface element, and the heat exchanger wall has at least one opening, so that the intermediate space communicates with the condensation cavity, and a capillary material is arranged in the condensation cavity, which extends to an outer surface of the heat exchanger panel, so that liquid condensing in the condensation cavity is transported to an outside of the heat exchanger panel due to the capillary effect of the capillary material.

2. The heat exchanger panel according to claim 1, wherein the heat exchanger panel further comprises a ceiling or wall panel in which the medium line is embedded, and the intermediate space is laterally enclosed by edge elements.

3. The heat exchanger panel according to claim 2, wherein the ceiling or wall panel and the edge elements are made of a diffusion-tight material.

4. The heat exchanger panel according to claim 1, wherein the capillary material is nonwoven or a fabric or a sorptive material or is formed as a polymer.

5. The heat exchanger panel according to claim 1, wherein the medium line comprises one or more straight line sections or consists of a meandering line.

6. The heat exchanger panel according to claim 1, wherein a region in which the condensation cavity is formed adjacent to the medium inlet comprises at least 10% of a length of the medium line.

7. The heat exchanger panel according to claim 1, wherein a plurality of openings are formed in the heat exchanger wall, the openings having a minimum clear width of at least 0.2 mm and/or a maximum clear width of 1.5 mm.

8. The heat exchanger panel according to claim 1, wherein the surface element exhibits a transmission of thermal radiation of more than 50% at a wavelength between 3 μm and 30 μm.

9. The heat exchanger panel according to claim 1, wherein a trough is provided on a ceiling- or wall-facing side of the heat exchanger panel, which trough encloses the ceiling or wall panel and/or encloses the medium line and the condensation cavity.

10. The heat exchanger panel according to claim 9, wherein the trough is made of a diffusion-tight material.

11. The heat exchanger panel according to claim 1, wherein a heat-insulating and/or sound-absorbing layer and/or a layer that is diffusion-tight with respect to water vapor is provided on a side of the heat exchanger panel facing away from the room.

12. The heat exchanger panel according to claim 1, wherein electronic components or thermal storage materials are arranged between the heat exchanger wall and the surface element and/or on a side of the surface element-facing the room.

13. A method for cooling a room with the heat exchanger panel according to claim 1, comprising the steps of conducting a cool heat exchanger medium in the medium line, condensation of moisture in the condensation cavity adjacent to the medium line, absorption of the moisture by a section of the capillary material arranged in the condensation cavity, and removal of moisture by means of the capillary effect of the capillary material to the outer surface of the heat exchanger panel.

* * * * *